United States Patent [19]

Forrest

[11] Patent Number: 4,538,704

[45] Date of Patent: Sep. 3, 1985

[54] MULTIPLE-PERSON EVACUATION METHOD AND APPARATUS

[75] Inventor: William E. Forrest, Denver, Colo.

[73] Assignee: Advanced Evacuation Systems, Denver, Colo.

[21] Appl. No.: 585,831

[22] Filed: Mar. 2, 1984

[51] Int. Cl.[3] ..... A62B 1/02; A62B 35/00

[52] U.S. Cl. ..... 182/10; 182/190; 182/3; 188/65.4

[58] Field of Search ..... 182/3–7, 182/10, 11, 190–193; 188/65.1, 65.4

[56] References Cited

U.S. PATENT DOCUMENTS

| | | | |
|---|---|---|---|
| 151,007 | 5/1874 | Bustin | 182/11 |
| 289,924 | 12/1883 | Morris | 182/3 |
| 293,322 | 2/1884 | Griswold | 182/10 |
| 296,769 | 4/1884 | Miller et al. | 182/191 |
| 317,704 | 5/1885 | Beale et al. | 182/10 |
| 338,843 | 3/1886 | Ilse | 182/10 |
| 386,237 | 7/1888 | Budd | 188/65.4 |
| 426,540 | 4/1890 | Matthaes | 182/10 |
| 453,134 | 5/1891 | Tallas et al. | 182/5 |
| 2,567,278 | 9/1951 | Finocchiaro | 182/11 |
| 3,026,959 | 3/1962 | Sweigart | 182/11 |
| 3,217,840 | 11/1965 | Holkesvick | 182/5 |
| 3,717,219 | 2/1973 | Hoffman | 182/6 |
| 4,341,285 | 7/1982 | Krickovich | 188/65.4 |
| 4,425,982 | 1/1984 | Kibbie | 182/3 |
| 4,440,261 | 4/1984 | Clark | 182/3 |

FOREIGN PATENT DOCUMENTS

| | | | |
|---|---|---|---|
| 801 | 1/1887 | United Kingdom | 182/3 |

*Primary Examiner*—Reinaldo P. Machado

*Attorney, Agent, or Firm*—Edwin L. Spangler, Jr.

[57] ABSTRACT

This invention relates to a multiperson emergency evacuation system characterized by a first rope used for the initial descent down the outside of the building, a combination anchoring and descent control fixture mountable adjacent the escape opening used to both anchor the upper end of a ground or rooftop-anchored fixed rope and for belaying with a second rope the personnel riding the fixed rope down by means of a friction drum mounted thereon, a body harness and a special connection for detachably fastening each individual escapee at spaced points intermediate the ends of the movable belay rope. The invention also encompasses the novel method of evacuating more than one person from the upper floors of a multistory building which comprises first erecting a fixture adjacent the escape opening having a drum-type friction belay feature, and then, assuming no one is on the ground to catch and anchor the fixed rope, sending one or more persons down to receive and anchor it while belaying them from above. After anchoring the lower end, the slack is removed from fixed rope at the upper end before tying it off. Next, a second movable belay rope used to belay the evacuees is rigged alongside the fixed rope. These evacuees are then harnessed and attached at fixed intervals to the movable rope at points outwardly of the descent control device and to the fixed rope so as to slide down the latter while belayed from above. The invention further features a novel knot and open-ended friction belay apparatus whereby turns can be added or subtracted without accessing the rope end even when loaded.

27 Claims, 5 Drawing Figures

MULTIPLE-PERSON EVACUATION METHOD AND APPARATUS

The prior art is replete with single rope evacuation systems and associated descent control devices which can be used to lower people one-at-a-time from a building, a cliff or any other elevated location. A list of these prior art systems can be found in my copending application Ser. No. 582,266, filed Feb. 22, 1984, now U.S. Pat. No. 4,508,193. I have, however, found only one prior art patent using a two rope escape system and it is the hundred year old Morris U.S. Pat. No. 289,924. I am unaware of any system regardless of the number of ropes used that I consider is suitable for use by unskilled persons in escaping from the upper floors of a burning building several at a time. Such a system requires a safe and foolproof apparatus and method of using same that as few as one trained person can use to evacuate many others who need no training or skill at all and, as a matter of fact, could even be unconscious.

The apparatus shown in the Morris patent is similar in some respects to my system but very different in others. His fixed rope O is anchored both above and below and the escapee rides it down to safety. A friction belay device controls the movement of the escapee as the movable rope E slides through the circuitous path provided in the latter. This belay device is anchored inside the structure and, while the escapee controls his own rate of descent, a second person inside the room or even on the ground could do likewise. Here, however, the similarity ends.

The Morris friction device requires that it be threaded which, of necessity, means accessing one end or the other of his rope E. In my belay device, on the other hand, it can be brought into use employing an intermediate section of the rope without accessing either end and even when under load.

Morris makes no provision for adjusting the friction to accommodate different loads. This is not too significant a limitation on his escape device since it is intended and designed for use by only one person. In my system, however, it is essential that provision be made in the belay device for accommodating different weight loads while under load without having to access an end of the movable rope or rethreading it because the system is specifically designed for multiple-person use and the variations in such loads demand this degree of versatility. I accomplish this by providing my belay device with an accessible open end permitting turns to be added or even removed from its friction drum while under load.

Morris includes no provision for adding additional escapees to the system. Access must, of course, be had to a free end of the fixed rope O in order to thread it through eye Q in connector G. Once this is done and the fixed rope anchored both inside the building and on the ground, there is no way shown of adding a second person to the fixed rope. The same is true of the movable rope. Once the movable rope is knotted or tied off beyond end H in the connector and the rope reaved through the belay device track, no way is shown for adding successive escapees in between, yet, the time constraints in an emergency demand that trapped victims be evacuated several at a time. My system provides for hooking onto the fixed rope as well as the movable one without accessing either end of either one. A sliding coupling is made with the fixed rope while a fixed one is made with the movable one at any intermediate point between either of their ends.

One major problem with the Morris system is, of course, the possibility of its jamming should the movable rope knot up or kink ahead of the confined track in the belay device. Should this happen, and it easily could while the escapee is on his or her way to the ground, there is no way of gaining access to the belay device so as to correct the condition unless a second person stays in the room. Even then, when under load, the escapee will, of necessity, have to be hoisted part way back up to free the track of the knot. My belay device is attended until the last person leaves the room. He or she then rides the fixed rope down in much the manner taught by Morris except that instead of leaving the belay device in the window opening where it is inaccessible should it jam, I prefer to have such person use the belay device of my copending application previously identified to control their rate of descent down to the ground or other place of safety which remains with them all the way along.

My method of evacuation is superior to any I am aware of and, so far as I know, it provides the simplest and safest way of escaping from a burning building or other structure when the conventional escape routes are unaccessible and the fire equipment will not reach.

It is, therefore, the principal object of the present invention to provide a novel and improved method for evacuating a number of people from upper floors of a multi-storied building where other escape routes are blocked and fire equipment on the ground will not reach up high enough.

A second objective is the provision of special apparatus for use in accordance with the novel method to safely control the descent of even unconscious victims to the ground or other place out of harms way.

Another object of the invention herein disclosed and claimed is to provide a two rope escape system and an exit fixture for use therewith that includes a friction type belay device, a detachable boom for getting the first people down to the ground with the fixed rope so as to not be obstructed by the side of the building.

Other objects will be in part apparent and in part pointed out specifically hereinafter in connection with the description of the drawings that follows and in which.

Figure 1:
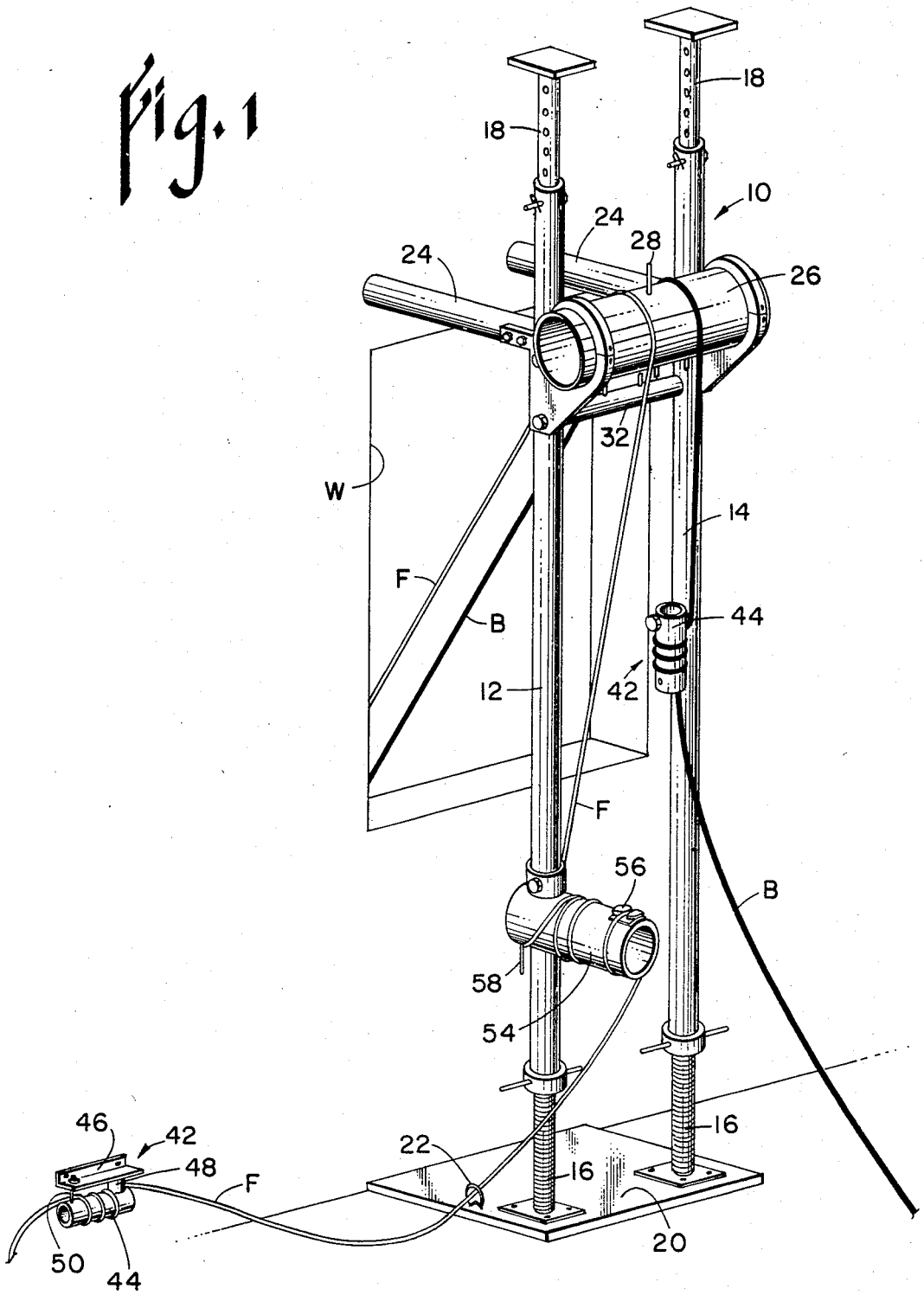
FIG. 1 is a perspective view showing the exit fixture, fixed and belay ropes rigged adjacent a window opening through which the personnel will be evacuated.

Referring next to the drawings for a detailed description of the present invention and, initially, to FIGS. 1, 2 and 3 for this purpose, reference numeral 10 has been selected to broadly designate what will be denominated here as an "exit fixture" which with the exception of certain elements that will be described presently, carries or is at least operatively associated with all of the elements that make up the escape system. The system as previously noted is a two rope system, one being a fixed rope F and the second a movable or belay rope B. The fixed rope F is the one the evacuees ride down to safety and it is anchored both on the ground and at the point of departure where exit fixture 10 is erected adjacent an escape opening which in this case is a window W.

A rope sold under the trademark "Kevlar" is well suited for use as the fixed rope since it is highly fire resistant (800° F.), is about twice as strong as "Nylon" rope of the same diameter and it has very little stretch. Its limitations are that it loses strength when knotted and, therefore, the recommended use is to not bend it around a diameter smaller than ten times its own thickness. Customary practice is to splice in an eye made of the same type of rope that can be placed over a large diameter anchor member thus avoiding having to tie a knot and risk weakening it. Alternatively, a knotless descent control device of a type which will be described in detail presently can be used as a primary ground anchor or backup anchor provided enough turns are taken around its drum to eliminate any slippage.

Once the escape route has been selected and the escape opening W freed of any obstructions, the exit fixture 10 can be erected. In the particular form shown in FIGS. 1, 2 and 3, it includes a pair of vertically-disposed stanchions 12 and 14 having screw jacks 16 at their lower ends and telescoping extensions 18 at their upper ends for adjusting the length thereof so as to reach from floor to ceiling. Once thus adjusted, jacks 16 are actuated to further elongate them and anchor the fixture in place. Jacks 16 preferably rest atop a baseplate 20 which abuts the adjacent wall containing the window and mounts rope guide 22. Horizontally-disposed braces 24 that extend from the stanchions to the wall above the window cooperate with the baseplate to maintain the stanchions vertical and the proper distance from the window. These braces, of course, have as their primary function that of bracing the exit fixture against the significant loads that will eventually be applied thereto in a direction to tilt same outwardly.

Bridging the gap between the stanchions at a height well above the window sill is an upper cross member 26 over which both the fixed and belay ropes are passed over (reaved) in side-by-side spaced relation as shown during the main evacuation procedure soon to be described. Preferably, an upstanding post 28 or similar divider can be used to insure that the two ropes will remain separated from one another; however, the way in which they are reaved on other elements of the exit fixture fairly well insures that they cannot overlap one another and become tangled. Cross member 26 is shown as being cylindrical in shape and oriented with its axis horizontal. In diameter, it is preferably at least ten times that of the fixed rope F assuming a Kevlar rope is used.

Figure 2:
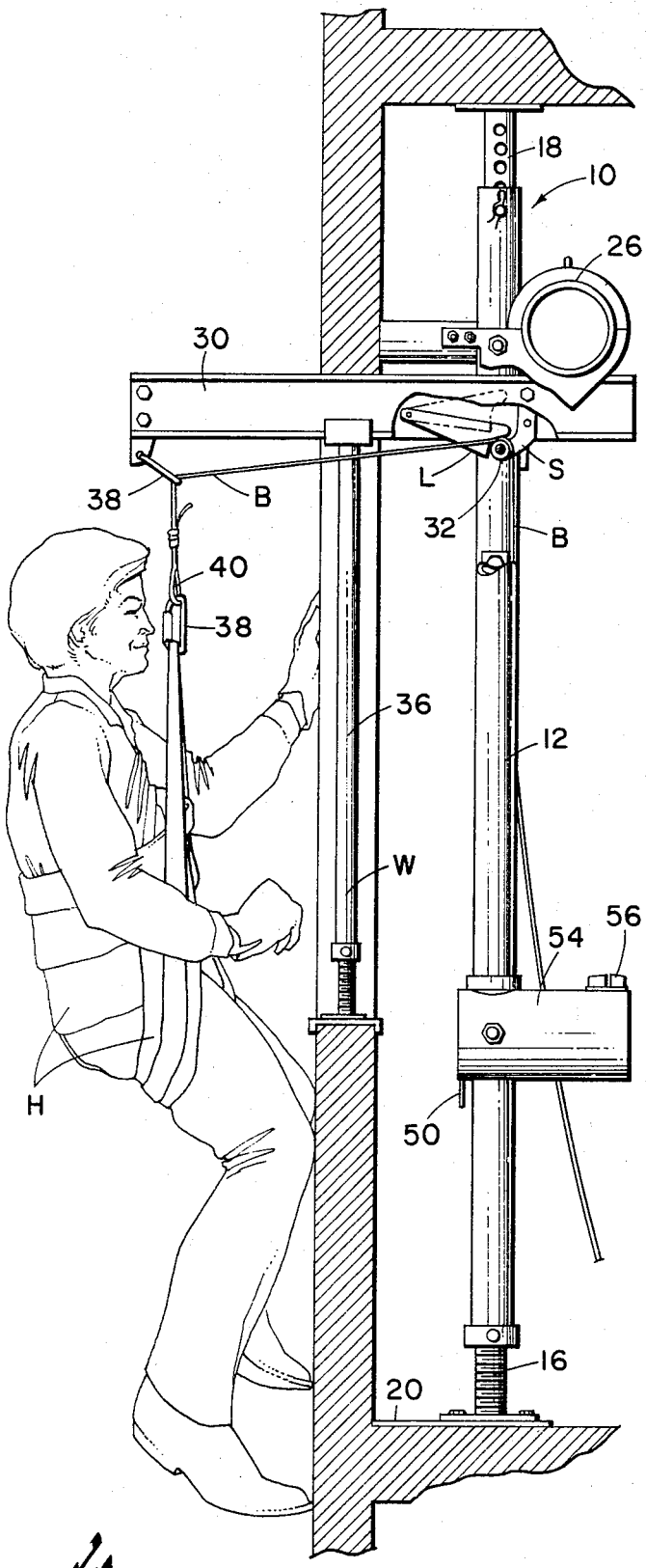
FIG. 2 is a side elevation to approximately the same scale as FIG. 1 showing the exit fixture rigged with a boom for lowering the first evacuee to the ground on the belay rope, portions having been broken away to more clearly reveal the interior construction.
Figure 3:
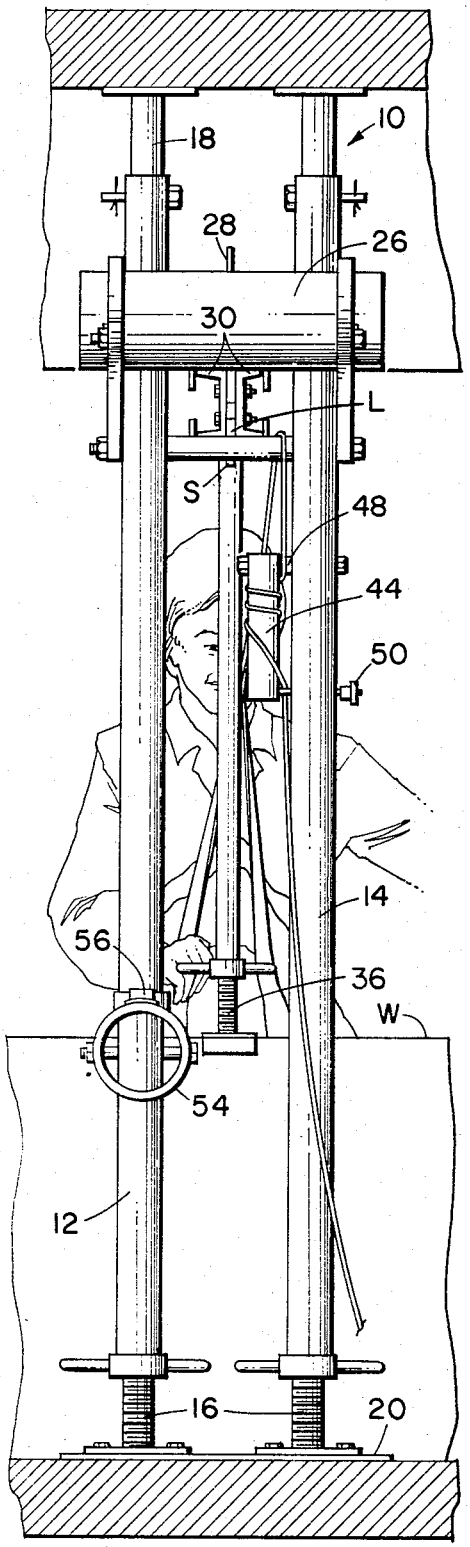
FIG. 3 is a rear elevation to the same scale as FIGS. 1 and 2 illustrating the same procedure as the latter figure viewed from the vantage point behind the exit fixture occupied by the person belaying the initial evacuee.

With the exit fixture in place and the window open, the next step is to get the fixed rope to the ground or other place of safety such as the roof of an adjacent building and anchored. This may be accomplished in any one of several ways, the primary consideration being how many people are going down with the first rope regardless of whether it ends up as the fixed rope or the belay rope. To be more specific, I have found it imperative to rig a boom 30 (see FIGS. 2 and 3) as a temporary attachment to the exit fixture if more than one person is going to make the initial descent. The reason is that with the first rope loaded and reaved inside the window over the cross member 26 or, for that matter, within the window opening as Morris shows, it is next to impossible to get a second person out attached to the rope above the first. A person hanging on the rope as shown in FIGS. 2 and 3, even though pushing against the side of the building, will not, in most instances, be strong enough to hold the rope thereabove away from the sill a distance such that the point where the second person attaches to the rope can get past the latter. If, on the other hand, only one person is going down on the initial descent, then the boom 30 is unnecessary although precautions should be taken to insure that the rope is not damaged by the window ledge such as placing a protector between the two.

While theoretically as above noted, a single person can anchor the fixed rope, circumstances will undoubtedly arise where two or more people are required for this purpose. For instance, handling several hundred feet of rope, pulling it out away from the building and anchoring it is no simple job for one person to accomplish. With time being of the essence, two or more people exiting by way of boom 30 is by far the safest and best approach. Therefore, with the exit fixture 10 in place, boom 30 should be added in the manner of FIGS. 2 and 3 by running out the window between upper and lower cross members 26 and 32 which are vertically spaced to receive same. As best seen in FIG. 2 a stop S hangs down from between the back-to-back channels making up boom 30 in position to engage the lower of the two cross members 32 thus limiting the outward excursion of the boom. A gravity latch L is pivoted between the boom channels and includes a cam surface 34 on the underside thereof that rides up over cross member 32 and out of the way into the phantom line position of FIG. 2 until the boom is fully extended against the stops, whereupon, it drops down in place on the window side of the aforementioned cross member as seen in full lines. As illustrated, a screw jack 36 cradles the underside of the boom and is extended down atop the window sill thus forcing the boom up snug against the lintel. The particular situation existing with regard to the exit opening will, of course, require appropriate modification of the exit fixture and associated hardware; however, these are well within the skill of the art.

While the initial descent can be made on either the fixed or the belay rope, I prefer the latter since the fixed rope if made of Kevlar has very little stretch to it and the evacuees could be injured in an uncontrolled drop of only a few feet. Nylon rope, on the other hand, stretches and is capable of absorbing or at least lessening the severity of such shocks. Another reason is that the belay rope provides the only means for getting the harnesses and other needed equipment such as medical supplies or even another person like, for example, a fireman or doctor, from the ground back up into the area being evacuated.

Assuming the belay rope B is selected and that two or more persons make the initial descent, the first one down merely hooks his body harness H or the functional equivalent thereof to the eye splice 40 in the end. The carabiner 38 on boom 30, of course, holds the rope well away from the side of the building as shown in FIG. 2. A person trained in the use of the system will then employ the first of the descent control devices that has been indicated broadly by reference numeral 42 (FIG. 3) to lower the first evacuee a few feet down the side of the building.

As seen in FIGS. 1 and 3, descent control device 42 comprises a friction drum 44 attached in fixed spaced substantially parallel relation to stanchion 14 or other suitable fixed support like, for example, bracket 46 shown for illustrative purposes fastened to the wall to the left of the window. In actual practice, this unit would not occupy a fixed position but rather be portable and provided with some type of sling made of Nylon webbing that could be tied around a post or other suitable anchor point close to the exit opening chosen for the evacuation. The spacer 48 holding drum 44 in fixed spaced relation to the support therefor which is most clearly seen in FIG. 3 must provide enough of a gap therebetween to easily receive the belay rope. This connector is smooth-surfaced so as to not abraid the rope which passes down under the latter before making several turns around the drum. More important, however, is the fact that spacer 48 is preferably positioned well up toward the top of the drum so as to leave its lower end open to receive as many turns of the belay rope as may be needed to belay the load consisting of perhaps as many as twenty evacuees. It is this important feature which differentiates my descent control device 42 from others in the prior art since I can add or subtract turns even when loaded without accessing an end of the belay rope by merely removing keeper pin 50 which bridges the gap between the stanchion 14 and the friction drum at the lower end of the latter. Morris' friction device, for instance, makes no provision for varying the friction to accommodate different size loads but, then again, he didn't need to since his two rope system is used purely and simply for one person to escape at a time and such loads are easily controlled. In mine, on the other hand, the person in charge of controlling the descent will undoubtedly find he or she has adequate control over the first two or three persons out the window but needs at least a couple of extra turns around drum 44 to belay, say, twenty evacuees all descending at one time. If so, he or she merely removes pin 50 while holding the turns already there against the drum then, taking ahold of the slack portion of the rope hanging therebeneath, uses it to wrap another few turns before replacing the pin. Pin 50 is, obviously, a most important element of the descent control device 42 and, therefore, it should be fastened with a short length of cable or the like to the stanchion alongside the drum as shown in FIG. 3. In addition, pin 50 preferably is of a type which releasably latches in place and must be manipulated in some way before it can be removed.

The second and subsequent persons to descend on the first rope whether it be the fixed rope or the belay rope do not, of course, have access to the end thereof as did the first evacuee. This means they must attach themselves to the rope between its end and the carabiner on the end of the boom. More than one type of rope clamp exists in the prior art suitable for this purpose, however, I prefer a device familar to mountain climbers called a "Jumar Ascender". The first evacuee merely attaches his or her body harness to the eye splice 40 using a carabiner 38 while the others in the original descent party, if any, use the Jumar Ascender or other equivalent rope connector fastenable intermediate the ends of the rope. Once the initial descent party is hooked up in the manner just described, a trained person in the room being evacuated slowly lowers them to the ground using the descent control device 42 on stanchion 14.

If the harnesses used by the first group to make the descent are needed back up at the evacuation site, they should immediately be removed and hauled back up the fixed rope along with any other equipment that might be needed. These harnesses are already fastened to the belay rope and eye 40 in the latter need only be clipped to the fixed rope using a carabiner to complete the set up.

If the initial descent party has used the fixed rope in their descent it must, of course, be anchored at the selected landing site. If not, and the belay rope has been used to get the first group of evacuees out of the building, then the fixed rope may either be passed down to them or they may take it along as they make the initial descent. Probably the best and most reliable way of getting the fixed rope from one building to another is to use a line-throwing gun of conventional design since it avoids the problem of having to get the fixed rope over power lines and other above-ground obstructions that would cause problems if the rope had to be taken all the way to the ground and back up. An apparatus of this type propels a light line fairly accurately to those awaiting it on the ground and it then is used to haul the heavier fixed line down to its anchor point. Firemen may be alerted and be present on an adjacent roof top or other landing site to receive the fixed rope and anchor it in which event all the evacuees will ride the fixed rope down and much valuable time can be saved by not having to send a party from the evacuation site to take care of the anchoring function.

Ordinarily, an evaucation of this magnitude will be in accordance with a prearranged plan wherein, among other things, one or more potential landing spots will have been chosen and each equipped with an anchor of some kind. If not, then the initial descent team or someone already on the ground will have to fine one and go about anchoring the fixed rope. Assuming the belay rope has been used for the initial descent, it will have to be carefully pulled back up into the evacuation station and coiled or wound onto the storage reel it was taken off of so as to insure it is not knotted or tangled. In many instances, there will be two ropes, each several hundred feet long and it is going to take a great deal of care, especially under emergency conditions, to keep them from getting tangled.

With the fixed rope anchored at a distant point well away from the base of the structure being evacuated, it will ordinarily be inclined at an angle due to the locations of cross member 26 high up in the exit opening such that the window sill no longer poses a problem, therefore, the boom 30 can be removed, the belay rope detached therefrom, and re-reaved over cross member 26 in the manner shown in FIG. 1. The fixed rope also passes over cross member 26 alongside the belay rope,; however, the fixed rope still needs to be tightened and secured at the exit fixture.

I have found the best, easiest and safest way to do this is to wrap several turns of the fixed rope around a large diameter friction drum 54 shown mounted on stanchion 12 with its axis substantially horizontal. More specifically, as shown in FIG. 1, I take the fixed rope as shown from cross member 26 around to the front or window side of stanchion 12, pass it underneath the portion of the drum projecting on that side, back around the other side of the stanchion and finally up, over and around the drum several turns. A pin 58 projecting from the underside of the drum spaced forwardly of the stanchion holds the turn of the rope on the window side in place.

Drum 54 is spaced well below cross member 26 so as to leave several feet of rope between the two which can be grasped and pulled down upon to remove the slack. I prefer to do this by having two people "leap-frog" along rope F with Jumar Ascenders detachably connected to it and using their body weight to take up the slack. At the same time, a third person takes up the slack on drum 54 preparatory to securing it using a conventional cam cleat 56 or some such tie-off device. Actually, I have found that five turns or more around the friction drums 44 and 54 constitute a lock-off where no further slippage occurs even with twenty people loaded on the fixed rope which is the method I prefer to use in preventing slippage. Nevertheless, cam cleat 56 provides a convenient rope-management fixture.

A secondary tie-off or anchor is highly desirable as an added safety precaution and I employ a second descent control device 42 for this purpose. While I show it attached to the wall I have already explained that this has only been done for illustrative purposes and I prefer it to be portable. As previously noted, a half dozen or so turns of the fixed rope around its drum 44 constitutes a lock-off. More significant, however, is the fact that the anchor is knotless and thus does not weaken the Kevlar fixed rope.

Figure 4:
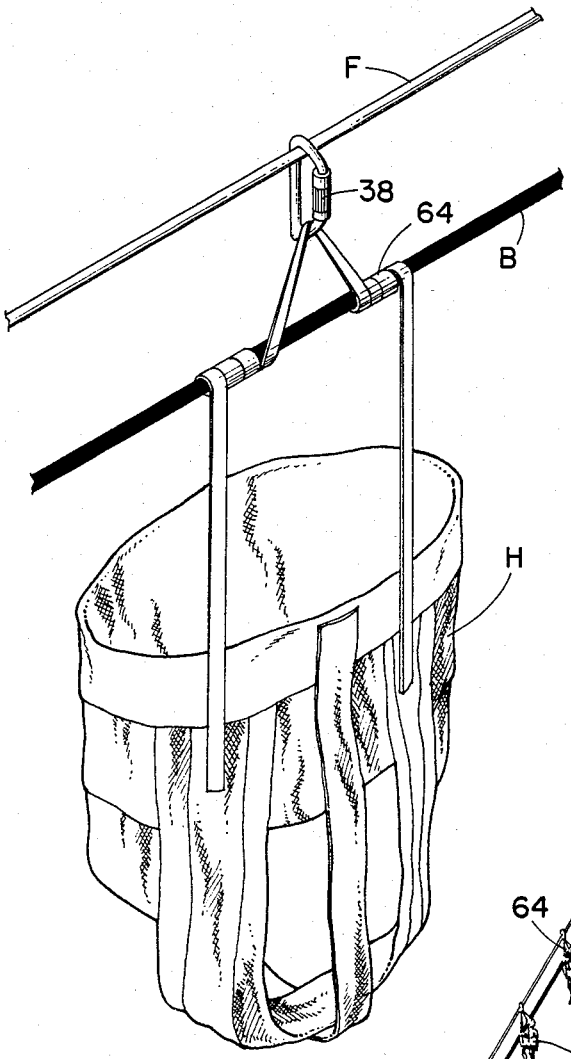
FIG. 4 is an enlarged fragmentary perspective view showing the body harness and knot used to attach the latter in fixed position to the belay rope and with a sliding connection on the fixed rope; and, FIG. 5 is another perspective view to a greatly reduced scale showing five evacuees riding the system down to a safe landing point simultaneously.

The initial set up shown in FIG. 1 is now complete and ready for the evacuation of the building occupants who have had no training whatsoever in the escape system. Various types of body harnesses can be used with my system, however, I prefer the one shown in FIG. 4 and identified by reference letter H which forms the subject matter of my copending design application filed Feb. 22, 1984, and bearing Ser. No. 582,269. It has the advantage of fitting any size evacuee who merely steps into it and has nothing to buckle, thread, tie, tighten or otherwise manipulate. Instead, as revealed in FIG. 4, the sack-type body carrier is already equipped with a strap 64 which need only be wrapped a couple of turns around the belay rope to define a non-slip connection therewith and then clipped to the fixed rope to form a sliding connection using a carabiner 38. The knot or connection 64 thus formed, while simple, is nonetheless unique as far as I am aware. Ordinarily, a person trained in the escape system will fasten each evacuee to the two ropes rather than risking them doing it themselves. I have tested my body carrier H and it can safely be used to lower even an unconscious person to the ground without danger of them falling out. There are, of course, other types of connections that can be made to fasten the body harness to the belay rope such as the Jumar Ascender used initially to lower the initial descent team to the ground but each of these is more complex, may require hardware, is slower to actuate and from what I have found, more subject to slippage and may even fall.

Figure 5:
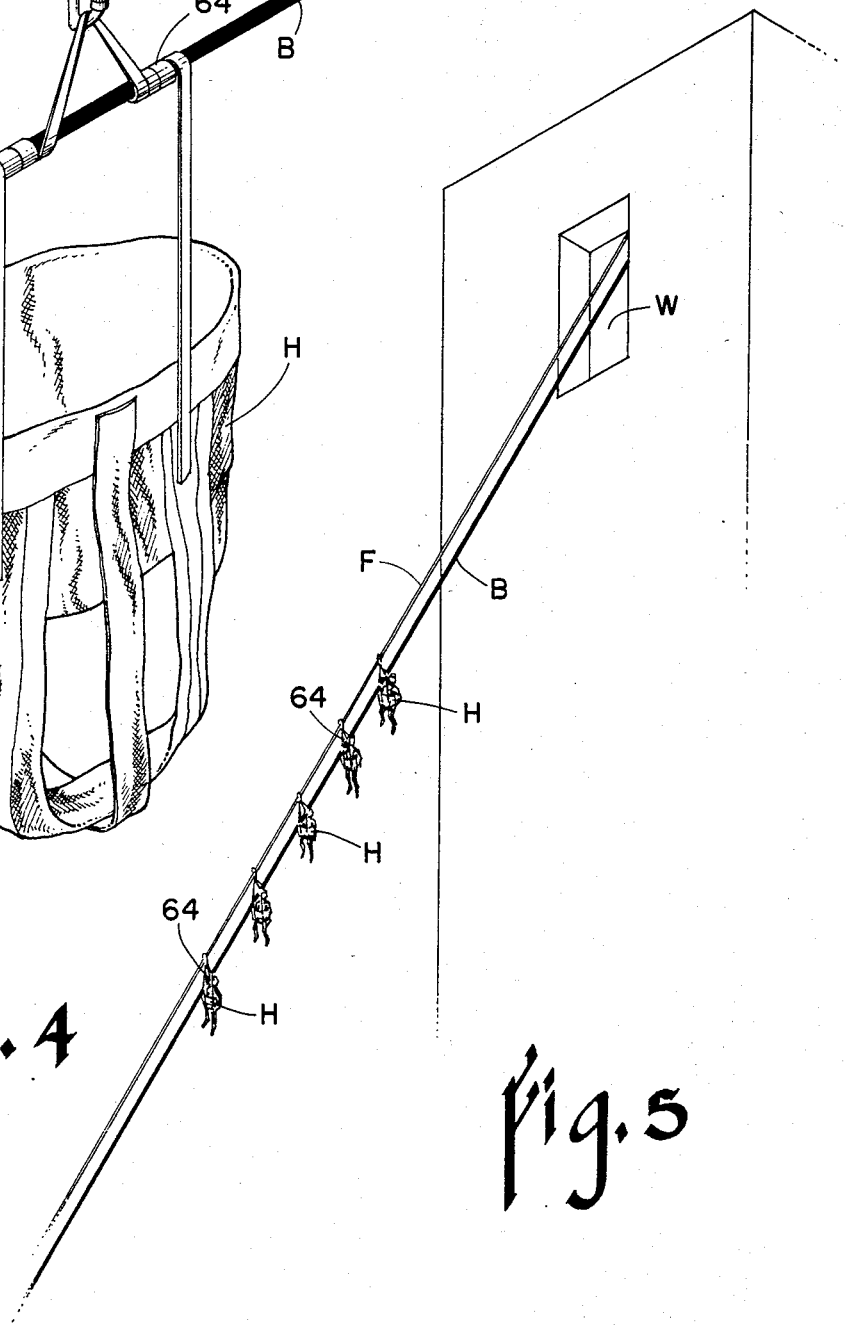

As each person in turn is attached as shown in FIG. 5 to the two rope system, they are lowered a short distance out of the window on the fixed rope belayed by the belay rope wrapped around descent control device 42 on stanchion 14. One would assume that the greater the load, the more turns that would be needed around the drum of the descent control device; however, this is not always the case. For instance, if a Nylon rope is used to belay the evacuees, it will stretch and flatten placing a greater surface area in contact with the drum as the load gets heavier thus on occasion, requiring that turns be removed, not added.

Spacings of five feet or so are left between successive evacuees. I find that twenty persons can make the descent at a time. With forty body harnesses available, twenty can be getting them on ready to be evacuated while another twenty are making their descent. As the first twenty reach safety, those on the ground get them out of their harnesses and send the latter back up with the belay rope to a third set of twenty evacuees waiting to put them on. This procedure is repeated over and over again until the people in the area being evacuated are all safely down except for the last person, presumably the one who is the best trained in the use of the system and in charge of the evacuation team. He then hooks his body harness onto the fixed rope using a carabiner, ties off the belay rope securely using the drum 44 of the descent control device on stanchion 14 and wrapping a half dozen or so turns therearound. With the belay rope thus secured, he will use an individual friction type escape device like that forming the subject matter of may previously mentioned copending application Ser. No. 582,266 to belay himself as he rides the fixed rope down.

What is claimed is:

1. In combination in a system for lowering several persons at a time outwardly through an exit opening in an elevated evacuation area to a landing site therebeneath: means including a rope support for positioning near the exit opening spaced well above the lower edge of the latter, a first rope to be anchored in the evacuation area preparatory to being passed out through the exit opening over said rope support and subsequently anchored at the landing site, a second rope to be reaved over said rope support alongside the first, a plurality of body harnesses, harness attachment means for connecting the body harnesses at fixed spaced intervals along a section of said second rope outwardly beyond said rope support, means for detachably connecting said harness attachment means to said first rope for sliding movement therealong outwardly beyond said rope support, and descent control means for use within the evacuation area ahead of said rope support for belaying the descent of persons occupying said body harness using said second rope as they descend the first, said means including a friction drum for receiving one or more turns of said second rope wrapped therearound, said drum having an open end whereby turns of said second rope taken from a slack section thereof hanging free from said drum can be added or taken off the latter without accessing an end thereof while the portion of said second rope beyond said drum is tensioned and under load.

2. The combination as set forth in claim 1 which includes: slack removal means in the form of a drum around which the first rope can be wound and pulled upon to take out any slack therein preparatory to anchoring same.

3. The combination as set forth in claim 1 which includes: boom-forming means detachably mountable in the top of the exit opening in position to project outwardly therethrough to a point spaced therebeyond a distance such that a loaded rope hanging from the outer end thereof will be sufficiently far from the wall containing said exit opening to permit an additional load to be added to said rope above the load already there and lowered past the exit opening without hanging up on the lower edge thereof.

4. The combination as set forth in claim 1 which includes: at least one extendable stanchion mounting the rope support, said stanchion being of a length adapted upon extension to reach between vertically-spaced abutments in the evacuation area above and below the exit opening.

5. The combination as set forth in claim 1 in which: the harness attachment means comprises a sling having one portion connectable to the body harness, an opposite portion defining a reverse bend detachably connectable to said first rope, and an intermediate portion effective when wrapped at least one turn around said second rope to form a non-slip connection therebetween when under load.

6. The combination as set forth in claim 1 which includes: first anchorage means for anchoring said first rope within the evacuation area.

7. The combination as set forth in claim 1 in which: the rope support comprises a horizontally-disposed substantially-cylindrical drum.

8. The combination as set forth in claim 1 wherein: the drum of the descent control means is closed at one end by fastening same to a support thereof in spaced substantially parallel relation thereto, and in which the combination includes means for bridging the gap between said drum and support adapted to temporarily close off said open end and retain the turns of said second rope wrapped therearound.

9. The combination as set forth in claim 3 in which: one of said first and second ropes and said boom cooperate when interconnected to form a subcombination for hoisting loads from the ground or other location beneath the exit opening into the evacuation area.

10. The combination as set forth in claim 3 in which: the rope support comprises a horizontally-disposed drum, and in which the boom-forming means is secured between said drum and the top of the exit opening.

11. The combination as set forth in claim 5 in which: the ends of the harness attachment means are attached to the body harness as a permanent part thereof.

12. The combination as set forth in claim 6 in which: said first anchorage means comprises a horizontally-disposed substantially-cylindrical drum of a length adapted to receive a sufficient number of turns of said first rope wound thereon in side-by-side relation to support a load of at least twenty persons without slipping.

13. The combination as set forth in claim 8 in which the drum is fastened with its axis substantially vertical, the closed end at the top and the open end thereof at the bottom.

14. The combination as set forth in claim 8 in which: the means for bridging the gap between the open end of the drum and the support therefor comprises a detachable latch pin.

15. The subcombination of a descent control device for use with a movable rope to belay the movement of a load down along a fixed rope strung between anchor points which comprises: a rigid support anchorable at the point of departure, a friction drum, means defining a spacer for attaching one end of said drum to said support so as to leave a rope-receiving gap therebetween and the other end of said drum open whereby turns of rope can be added or subtracted therefrom without accessing an end of said rope.

16. The subcombination of claim 15 which includes: openable gate-forming means bridging the gap between said open drum end and the support therefor, said means when closed being effective to cooperate with said spacer and retain the rope turns therebetween on the drum.

17. The subcombination of a knot for use with a load-carrying harness to attach the latter in fixed position on a movable rope to slide along a fixed rope which comprises: a flexible strap folded intermediate its ends to define a reverse bend detachably connectable to the fixed rope for sliding movement therealong while said ends are attached to said load in supporting relation thereto and the portions of said strap intermediate its ends and reverse bend are wrapped around the movable rope a sufficient number of turns to prevent slippage therebetween with the load hanging therebeneath.

18. The method of evacuating several persons at the same time through an exit opening in an evacuation area to a safe landing site therebeneath which comprises the steps of: rigging a rope support in spaced relation above the bottom of the exit opening, anchoring one end of a first rope in the evacuation area and passing same outwardly over the rope support to a second anchorage at the landing site, passing one end of a second rope over the rope support and out through the exit opening, harnessing each of several persons to be evacuated at fixed spaced intervals on said second rope between the said one end thereof and the rope support, detachably connecting the persons thus harnessed to said first rope for sliding movement therealong, and controlling the descent of the persons descending on the first rope by means of the second rope from within the evacuation area.

19. The method as set forth in claim 18 which includes the steps of: rigging a boom in the top of the exit opening so as to project outwardly therebeyond, and using one of said first and second ropes rigged at the extended end of said boom to lower one or more persons to the ground or some intermediate landing point by belaying them from within the evacuation area preparatory to anchoring the first rope.

20. The method as set forth in claim 18 which includes the step of: removing the slack from the first rope inside the evacuation area after anchoring same at the landing site but before anchoring it at the point of departure.

21. The method as set forth in claim 18 which includes: changing the number of turns of the second rope around the drum of a friction type descent control device as the load increases.

22. The method as set forth in claim 18 which includes: alternately hanging the body weight of two or more persons on the unanchored portion of the first rope inside the evacuation area with the lower end thereof anchored at the landing site to remove the slack therefrom preparatory to anchoring its upper end.

23. The method as set forth in claim 18 wherein: the lower end of the first rope is anchored at a landing site located at a distance from the exit opening selected such that the persons descending said first rope clear the lower edge of said opening.

24. The method as set forth in claim 19 which includes the step of: removing the boom before anchoring the first rope.

25. The method as set forth in claim 19 wherein: the second rope is used to lower the first persons to the ground.

26. The method as set forth in claim 19 which includes the step of: hoisting one or more loads from the ground back up into the evacuation area using the boom and the rope upon which the initial descent was made.

27. The method as set forth in claim 25 in which: the first persons descending on the second rope carry the end of the first rope with them that is to be anchored at the landing site.

* * * * *